US007019047B2

(12) United States Patent
Shriver et al.

(10) Patent No.: US 7,019,047 B2
(45) Date of Patent: Mar. 28, 2006

(54) ACRYLATE-FREE BINDERS CONTAINING AN EPOXY RESIN AND AN ALKYL SILICATE

(75) Inventors: H. Randall Shriver, Columbus, OH (US); Xianping Wang, Dublin, OH (US); Jorg Kroker, Powell, OH (US)

(73) Assignee: Ashland Licensing and Intellectual Property LLC, Dublin, OH (US)

( * ) Notice: Subject to any disclaimer, the term of this patent is extended or adjusted under 35 U.S.C. 154(b) by 0 days.

(21) Appl. No.: 10/628,056

(22) Filed: Jul. 25, 2003

(65) Prior Publication Data

US 2005/0020727 A1 Jan. 27, 2005

(51) Int. Cl.
*B22C 1/22* (2006.01)
*B22C 1/16* (2006.01)

(52) U.S. Cl. ..... 523/139; 523/145; 523/147; 164/75

(58) Field of Classification Search ..... 523/139, 523/145, 147; 164/75
See application file for complete search history.

(56) References Cited

U.S. PATENT DOCUMENTS

| | | | | |
|---|---|---|---|---|
| 3,401,735 | A * | 9/1968 | Pursall | 164/40 |
| 3,632,844 | A * | 1/1972 | Robins | 523/143 |
| 4,518,723 | A | 5/1985 | Woodson | 523/466 |
| 4,526,219 | A | 7/1985 | Dunnavant et al. | 164/16 |
| 4,806,576 | A | 2/1989 | Woodson | 523/139 |
| 5,169,880 | A * | 12/1992 | Yoshida et al. | 523/145 |
| 6,037,389 | A * | 3/2000 | Archibald et al. | 523/142 |
| 6,136,888 | A | 10/2000 | Torbus et al. | 523/142 |
| 6,465,542 | B1 * | 10/2002 | Torbus et al. | 523/143 |
| 6,604,567 | B1 * | 8/2003 | Woodson et al. | 164/75 |

FOREIGN PATENT DOCUMENTS

DE 19727540 A1 3/1998

* cited by examiner

*Primary Examiner*—Tae H. Yoon
(74) *Attorney, Agent, or Firm*—David L. Hedden

(57) ABSTRACT

This invention relates to foundry binder systems, which cure in the presence of sulfur dioxide and an oxidizing agent, comprising (a) an epoxy resin; (b) an alkyl silicate; (c) an ester of a fatty acid, (d) an effective amount of a oxidizing agent, and (e) no ethylenically unsaturated monomer or polymer. The foundry binder systems are used for making foundry mixes. The foundry mixes are used to make foundry shapes (such as cores and molds) which are used to make metal castings, particularly ferrous castings.

10 Claims, No Drawings

ACRYLATE-FREE BINDERS CONTAINING AN EPOXY RESIN AND AN ALKYL SILICATE

FIELD OF THE INVENTION

This invention relates to foundry binder systems, which cure in the presence of sulfur dioxide and an oxidizing agent, comprising (a) an epoxy resin; (b) an alkyl silicate; (c) an ester of a fatty acid, (d) an effective amount of a oxidizing agent, and (e) no ethylenically unsaturated monomer or polymer. The foundry binder systems are used for making foundry mixes. The foundry mixes are used to make foundry shapes (such as cores and molds) which are used to make metal castings, particularly ferrous castings.

DESCRIPTION OF THE RELATED ART

In the foundry industry, one of the procedures used for making metal parts is "sand casting". In sand casting, disposable molds and cores are fabricated with a mixture of sand and an organic or inorganic binder. The foundry shapes are arranged in core/mold assembly, which results in a cavity into which molten metal will be poured. After the molten metal is poured into the assembly of molds and cores and cools, the metal part formed by the process is removed from the assembly. The binder is needed so the molds and cores will not disintegrate when they come into contact with the molten metal.

Two of the prominent fabrication processes used in sand casting are the no-bake and the cold-box processes. In the no-bake process, a liquid curing catalyst or co-reactant is mixed with an aggregate and binder to form a foundry mix before shaping the mixture in a pattern. The foundry mix is shaped by putting it into a pattern and allowing it to cure until it is self-supporting and can be handled. In the cold-box process, a gaseous curing catalyst or co-reactant is passed through a shaped mixture (usually in a corebox) of the aggregate and binder to cure the mixture.

A cold-box process widely used in the foundry industry for making cores and molds is the "$SO_2$ cured epoxy/acrylate system". In this process, a mixture of a hydroperoxide (usually cumene hydroperoxide), an epoxy resin, a multifunctional acrylate, typically a coupling agent, and optional diluents, are mixed into an aggregate (sand) and compacted into a specific shape, typically a core or mold. Sulfur dioxide ($SO_2$), optionally diluted with nitrogen or another inert gas, is blown into the binder/aggregate shape. The shape is instantaneously hardened and can be used immediately in a foundry core/mold system. In this binder system, the acrylate component must be kept separate from the hydroperoxide until the binder is applied to sand, otherwise, free radical polymerization of the acrylate component will begin prematurely and render the binder useless.

BRIEF SUMMARY OF THE INVENTION

The subject invention relates to foundry binder systems, which cure in the presence of gaseous sulfur dioxide and an oxidizing agent, comprising:

(a) 40 to 80 parts by weight of an epoxy resin;

(b) 1 to 40 parts of an ester of a fatty acid;

(c) 1 to 10 parts of an alkyl silicate;

(d) an effective amount of an oxidizing agent; and (e) 0 parts of an ethylenically unsaturated monomer or polymer.

wherein (a), (b), (c), and (d) are separate components or mixed with another of said components, and where said parts by weight are based upon 100 parts of binder.

It has been found that addition of the alkyl silicate to this acrylate-free binder provides foundry shapes that have enhanced hot strength as measured by erosion resistance and hot tensile strength. The improvements in tensile strength development permits the foundry to uses lower binder levels in the core-making process. This is beneficial in the casting of both light metal (e.g. aluminum) and ferrous parts.

Another advantage of the binder, because it is acrylate-free, is that all of the components of the binder can be sold and used in one package. This simplifies the customer's binder storage and handling operations.

The foundry binders are used for making foundry mixes. The foundry mixes are used to make foundry shapes, such as cores and molds, which are used to make metal castings.

DETAILED DESCRIPTION OF THE INVENTION

The detailed description and examples will illustrate specific embodiments of the invention will enable one skilled in the art to practice the invention, including the best mode. It is contemplated that many equivalent embodiments of the invention will be operable besides these specifically disclosed. All percentages are percentages by weight unless otherwise specified.

An epoxy resin is a resin having an epoxide group, i.e.,

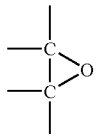

such that the epoxide functionality of the epoxy resin (epoxide groups per molecule) is equal to or greater than 1.9, typically from 2.0 to 4.0.

Examples of epoxy resins include (1) diglycidyl ethers of bisphenol A, B, F, G and H, (2) halogen-substituted aliphatic epoxides and diglycidyl ethers of other bisphenol compounds such as bisphenol A, B, F, G, and H, and (3) epoxy novolacs, which are glycidyl ethers of phenolic-aldehyde novolacs, (4) cycloaliphatic epoxy resins, and (5) mixtures thereof.

Epoxy resins (1) are made by reacting epichlorohydrin with the bisphenol compound in the presence of an alkaline catalyst. By controlling the operating conditions and varying the ratio of epichlorohydrin to bisphenol compound, products of different molecular weight can be made. Epoxy resins of the type described above based on various bisphenols are available from a wide variety of commercial sources.

Examples of epoxy resins (2) include halogen-substituted aliphatic epoxides, diglycidyl ethers of other bisphenol compounds such as bisphenol A, B, F, G, and H, and epoxy novolac resins. Examples of halogen-substituted aliphatic epoxides include epichlorohydrin, 4-chloro-1, 2-epoxybutane, 5-bromo-1,2-epoxypentane, 6-chloro-1,3-epoxyhexane and the like.

Examples of epoxy novolacs (3) include epoxy cresol and epoxy phenol novolacs, which are produced by reacting a novolac resin (usually formed by the reaction of orthocresol or phenol and formaldehyde) with epichlorohydrin, 4-chloro-1, 2-epoxybutane, 5-bromo-1,2-epoxypentane, 6-chloro-1, 3-epoxyhexane and the like.

Examples of cycloaliphatic epoxy resins include any aliphatic, cycloaliphatic, or mixed aliphatic-cycloaliphatic epoxide having any aliphatic groups, and further includes aliphatic epoxy resins having aromatic groups, i.e. mixed aliphatic-aromatic epoxy resins. The aliphatic epoxy resin may contain monomeric epoxide compounds in admixture with polymeric epoxide compounds. The most preferred aliphatic epoxy resins are represented by the following structural formulae:

(I)

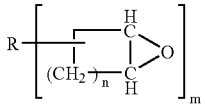

where "n"≧1 and "m" is a whole number, typically from 1 to 4, preferably from 2–3, or (II)

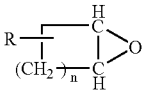

where "n"≧1.

R in structures I and II is predominantly aliphatic in nature, but may contain oxygen functionality as well as mixed aliphatic-aromatic groups. Typically, R is selected from the group consisting of alkyl groups, cycloalkyl groups, mixed alkyl-cycloaliphatic groups, and substituted alkyl groups, cycloalkyl groups, or alkyl-cycloaliphatic groups, where the substituents include, for example, ether, carbonyl, and carboxyl groups.

Specific examples of aliphatic epoxy resins include 3,4-epoxycyclohexylmethyl-3,4-epoxycyclohexane carboxylate; vinylcyclohexene dioxide; 2-(3,4-epoxycyclohexyl-5, 5-spiro-3,4-epoxy)cyclohexane-meta-dioxane; bis-(3,4-epoxycyclohexyl)adipate; 1,2 -epoxy-p-vinylcyclohexene; limonene dioxide; limonene monoxide; and hydrogenated bisphenol diglycidyl ethers.

Preferably used are epoxy resins having an average epoxide functionality of at least 2.1 to 3.5, preferably from about 2.3 to about 3.0. Particularly preferred are epoxy resins having an average weight per epoxy group of 165 to 200 grams/equivalent.

Although it is contemplated that any esters of a fatty acid can be used in this invention, preferably used are esters of fatty acids where the fatty acid used to prepare the ester has a carbon chain of 12 carbon atoms or more, particularly 12 to 22 carbon atoms. Preferably the ester group of the ester of the fatty acid has 1 to 8 carbon atoms. The esters of the fatty acids can be readily prepared by transesterification of fats and oils of plant or animal origin, which are normally available in the form of triglycerides or can be prepared by esterification of fatty acids obtained from such fats and oils.

Rapeseed oil methyl ester is a typical example of an ester derived from plant oil; it is a suitable solvent, particularly since it is available at low cost in the form of diesel fuel. But the esters of other plant oils, such as soybean oil, linseed oil, sunflower oil, peanut oil, tung oil, palm kernel oil, coconut oil, castor oil and/or olive oil, can also be used. In addition, marine animal oil, tallow oil, and animal fats can also serve as starting materials for alkyl esters that are to be used according to this invention.

The alkyl silicates used in the binder may be monomeric or polymeric alkyl silicates. Examples of monomeric alkyl silicates include tetraethyl orthosilicate, tetramethyl orthosilicate, and mixed alkyl silicates. Examples of polymeric alkyl silicates include oligomers of alkyl silicates, such as Dynasil 40, oligomers of alkoxy trialkoxysilanes, oligomers of dialkyl dialkoxysilanes, such as Silbond 40, and oligomers of trialkyl monoalkoxysilanes. Preferably used are tetraethyl orthosilicate and polyethylsilicate.

The oxidizing agent is a peroxide and/or hydroperoxide. Examples include ketone peroxides, peroxy ester free radical initiators, alkyl oxides, chlorates, perchlorates, and perbenzoates. Preferably, however, the free radical initiator is a hydroperoxide or a mixture of peroxide and hydroperoxide. Hydroperoxides particularly preferred in the invention include t-butyl hydroperoxide, cumene hydroperoxide, paramenthane hydroperoxide, etc. The organic peroxides may be aromatic, aliphatic, or mixed aromatic-aliphatic peroxides.

Examples of useful diacyl peroxides include benzoyl peroxide, lauroyl peroxide and decanoyl peroxide. Examples of mixed aromatic-aliphatic and aliphatic peroxides respectively include dicumyl peroxide and di-t-butyl peroxide.

Solvents may also be added to the binder formulation. Typically, a solvent is used to reduce the viscosity of the binder, such that the resulting viscosity of the epoxy resin component is less than 1,000 centipoise, preferably less than 400 centipoise. Generally, the total amount of solvent is used in an amount of 0 to 25 weight percent based upon the total weight of the epoxy resin. Solvents that can be used include polar solvents, such as liquid dialkyl esters, e.g. dialkyl phthalate of the type disclosed in U.S. Pat. No. 3,905,934, and other dialkyl esters such as dimethyl glutarate, dimethyl succinate, dimethyl adipate, and mixtures thereof. Suitable aromatic solvents are benzene, toluene, xylene, ethylbenzene, and mixtures thereof. Preferred aromatic solvents are mixed solvents that have an aromatic content of at least 90% and a boiling point range of 138° C. to 232° C. Suitable aliphatic solvents include kerosene.

The binder may also contain a silane coupling agent having the following general formula:

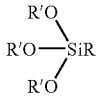

wherein R' is a hydrocarbon radical and preferably an alkyl radical of 1 to 6 carbon atoms and R is an alkyl radical, an alkoxy-substituted alkyl radical, or an alkyl-amine-substituted alkyl radical in which the alkyl groups have from 1 to 6 carbon atoms. The silane is preferably added to the binder in amounts of 0.01 to 2 weight percent, preferably 0.1 to 0.5 weight percent based on the weight of the binder.

Polyols such as phenolic resins, polyester resins, amine polyols, polyester polyols, and polyether polyols can also be used in the foundry binder.

Examples of phenolic resins include phenolic resole resins, particularly benzylic ether phenolic resole resins, including alkoxy-modified benzylic ether phenolic resole resins. Benzylic ether phenolic resole resins, or alkoxylated versions thereof, are well known in the art, and are specifically described in U.S. Pat. Nos. 3,485,797 and 4,546,124.

Polyether polyols are prepared by reacting an alkylene oxide with a polyhydric alcohol in the presence of an appropriate catalyst such as sodium methoxide according to methods well known in the art.

The polyester polyols may be aliphatic and/or aromatic polyester polyols. These polyols generally having a hydroxyl number from about 200 to 2,000, preferably from 250 to 700.

The components of the binder can be combined as one component and added to the foundry aggregate, or can be added separately or in various combinations.

It will be apparent to those skilled in the art that other additives such as silicones, release agents, defoamers, wetting agents, etc. can be added to the aggregate, or foundry mix. The particular additives chosen will depend upon the specific purposes of the formulator.

Typically, the amounts of the components used in the binder system are from 40 to 80 parts by weight of epoxy resin, preferably from 50 to 70 parts by weight; from 1 to 40 parts by weight of an ester of a fatty acid, preferably from 15 to 30 parts by weight; from 1 to 10 parts by weight of an alkyl silicate, preferably from 2 to 8 parts by weight; and from 10 to 40 parts by weight of oxidizing agent, preferably from 12 to 30 parts by weight, where the parts by weight are based upon 100 parts of binder system.

Various types of aggregate and amounts of binder are used to prepare foundry mixes by methods well known in the art. Ordinary shapes, shapes for precision casting, and refractory shapes can be prepared by using the binder systems and proper aggregate. The amount of binder and the type of aggregate used are known to those skilled in the art. The preferred aggregate employed for preparing foundry mixes is sand wherein at least about 70 weight percent, and preferably at least about 85 weight percent, of the sand is silica. Other suitable aggregate materials for ordinary foundry shapes include zircon, olivine, aluminosilicate, chromite sands, and the like.

In ordinary sand type foundry applications, the amount of binder is generally no greater than about 10% by weight and frequently within the range of about 0.5% to about 7% by weight based upon the weight of the aggregate. Most often, the binder content for ordinary sand foundry shapes ranges from about 0.6% to about 5% by weight based upon the weight of the aggregate in ordinary sand-type foundry shapes.

The foundry mix is molded into the desired shape by ramming, blowing, or other known foundry core and mold making methods. The shape is then cured almost instantaneously by the cold-box process, using vaporous sulfur dioxide as the curing agent (most typically a blend of nitrogen, as a carrier, and sulfur dioxide containing from 35 weight percent to 65 weight percent sulfur dioxide), described in U.S. Pat. Nos. 4,526,219 and 4,518,723, which are hereby incorporated by reference. The shaped article is preferably exposed to effective catalytic amounts of gaseous sulfur dioxide, and, optionally, a carrier gas can be used. The exposure time of the sand mix to the gas is typically from 0.5 to 10 seconds. The foundry shape is cured after gassing with sulfur dioxide. Oven drying may be needed if the foundry shape is coated with a refractory coating.

The core and/or mold may be formed into an assembly. When making castings, the assembly may be coated with a water-based refractory coating and passed through a conventional or microwave oven to remove the water from the coating.

Abbreviations

The abbreviations used in the examples are as follows:

SCA silane coupling agent.

Bis-F Epoxy a bisphenol-F epoxy resin having a functionality of 2.0, an epoxide equivalent weight of about 165–170 g/eq., and a viscosity 3,500 cp @ 25° C.

CHP cumene hydroperoxide.

RME rapeseed methyl ester, Connester 6020 sold by OELMUEHLE LEER of Germany.

PES polyethylsilicate, (Dynasil 40 by DEGUSSA Corp.).

Refractory Coating aqueous graphite based coating applied at 32° Baume by dipping cores, VELVAPLAST® CGW 9022 manufactured by Ashland.

EXAMPLES

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application, all units are in the metric system and all amounts and percentages are by weight, unless otherwise expressly indicated.

Testing Protocol

Measurement of Erosion Resistance

The shape of the erosion wedge and a diagram of the test method are shown in FIG. 7 of "Test Casting Evaluation of Chemical Binder Systems," W L Tordoff et al, AFS Transactions, 80-74, (pages 152–153), developed by the British Steel Casting Research Association, which is hereby incorporated by reference. According to this test, molten iron (1480° C.) is poured through a pouring cup into a 1" diameter×16" height sprue, impinges upon the wedge-shaped test mold at an angle of 60°, to fill a vented sand reservoir.

When the mold cavity is filled, pouring was stopped and the specimen allowed to cool. When cool, the erosion test wedge was removed and the erosion rating determined. If erosion has occurred, it shows up as a protrusion on the slant side of the test wedge.

Resistance to erosion was evaluated based on the results of the tests and the uncoated cores made with the binders. The severity of the erosion is indicated by assigning a numerical rating: 1=Excellent, 2=Good, 3=Fair, 4=Poor, 5=Very poor. This is a very severe erosion test. A rating of 1 or 2 generally implies excellent erosion resistance in actual foundry practice, if the same refractory/binder type and ratio are used. A rating of 3 or higher indicates that a coating is needed. In some tests where erosion is particularly severe, a rating of 5+ may be given, indicating off-scale erosion.

Wedge molds for the erosion wedge casting test were gassed 6.0 seconds with a 50/50 $SO_2$/nitrogen mixture delivered by an MT Systems $SO_2$/nitrogen blending unit, followed by a 30-second dry air purge.

Measurement of Hot Tensile Strength

"Dog bone" shaped cores were used to test the tensile strengths of the cores according to AFS test #329-87-S. How well a binder system bonds an aggregate (sand) together is typically compared using tensile strength measurements and given in pounds per square inch (psi). Sufficient core strength is needed once the binder/sand mix is cured to prevent the core/mold from distorting or cracking during assembly operation. This is especially important when cores/molds are dipped in a refractory coating solution and dried in a conventional or microwave oven. Hot tensile strength measurements are taken immediately after removing the water-based coated tensile test specimens from the drying oven. Binder systems that retain higher hot tensile strengths coming out of a drying oven can better retain their dimensional accuracy and have less core breakage problems.

Comparison Example A

A binder, having no acrylic component and no alkyl silicate, was used in this example. The composition of the binder follows:

| | |
|---|---|
| Bis F Epoxy | 56.3% |
| RME | 23.5 |
| CHP | 20.0 |
| SCA | 0.2 |

A foundry mix was prepared by mixing 3000 grams of silica sand and 30 grams of the binder for 4 minutes using a Hobart sand mixer.

Test wedge cores, weighing 4 pounds each, were prepared by adding 1.0 weight percent of the binder to 2000 grams of silica sand, blowing the mixture into a metal wedge pattern, gassing it with 65% sulfur dioxide in nitrogen for 1.5 seconds, and then purging with air for 10 seconds.

The casting obtained from the test wedge core bonded with the binder of Comparison Example A was given an erosion rating of 2.5 (Fair).

Example 1

Comparison Example A was repeated, except an alkyl silicate (PES) was added to the binder. The binder components are set forth below:

| | |
|---|---|
| Bis F Epoxy | 51.3% |
| RME | 23.5 |
| CHP | 20.0 |
| PES | 5.0 |
| SCA | 0.2 |

The casting obtained from the test wedge core bonded with the binder of Example 1 was given an erosion rating of 1.5 (excellent).

Comparison Example A and Example 1 demonstrate the effect of adding an alkyl silicate to the acrylate-free binder. The resulting erosion rating improved from "fair" to "excellent". This improvement in erosion would enable one to dispense with using a core coating in some applications.

Comparison Example B

A foundry mix, which did not contain an alkyl silicate, was prepared as in Comparison Example A. The foundry mix was formed into a test mold, cured and evaluated for hot tensile strengths as previously described. The hot tensile strengths of three test specimens of this sand/binder mix averaged 17 psi.

Example 2

Comparison Example B was repeated with the binder of Example 1. The hot tensile strengths of three test specimens of this sand/binder mix averaged 24 psi.

Comparison Examples B and Example 2 demonstrate the effect in hot strength of adding an alkyl silicate to an acrylate-free binder. The resulting hot tensile strength improvement was over 40% for the cores prepared with the binder containing the alkyl silicate.

The results of the Examples are summarized in Table I.

TABLE I (Summary of test results)

| Example | EPS (pbw) | Erosion Rating | Hot Tensile (psi) |
|---|---|---|---|
| A | 0 | fair | — |
| 1 | 5 | excellent | — |
| B | 0 | — | 17 |
| 2 | 5 | — | 24 |

The data in table I indicate that cores made with the binder containing the alkyl silicate are more erosion resistant and have improved hot tensile strengths.

We claim:

1. A foundry binder system, which will cure in the presence of sulfur dioxide and an oxidizing agent, comprising:

(a) 40 to 80 parts by weight of an epoxy resin;

(b) 1 to 40 parts of an ester of a fatty acid;

(c) 1 to 10 parts of an alkyl silicate;

(d) an effective amount of an oxidizing agent; and (e) 0 parts of an ethylenically unsaturated monomer or polymer, wherein (a), (b), (c), and (d) are separate components or mixed with another of said components, and where said parts by weight are based upon 100 parts of binder.

2. The binder system of claim 1 wherein the wherein the epoxy resin is selected from the group consisting of epoxy resins derived from bisphenol A, epoxy resins derived from bisphenol F, epoxidized novolac resins, cycloalphatic epoxy resins, and mixtures thereof.

3. The binder system of claim 2 wherein the epoxy resin has an epoxide equivalent weight of about 165 to about 225 grams per equivalent.

4. The foundry binder system of claim 3 which further comprises a polyol selected from the group consisting of phenolic resole resins, polyester polyols, and polyether polyols.

5. The binder system of claim 4 wherein the oxidizing agent is cumene hydroperoxide.

6. The foundry binder system of claim 5 wherein the amount of epoxy resin is from 50 to 70 parts by weight, the amount of ester of a fatty acid is from 15 to 30 parts by weight, the amount of alkyl silicate is from 2 to 8, and the amount of amount of a oxidizing agent is from 12 to 30 parts by weight, where the weights are based upon 100 parts of the binder system.

7. A foundry mix comprising:

(a) a major amount of foundry aggregate;

(b) an effective bonding amount of the foundry binder system of claim 1, 2, 3, 4, 5, or 6.

8. A cold-box process for preparing a foundry shape comprising:

(a) introducing the foundry mix of claim 7 into a pattern; and (b) curing with gaseous sulfur dioxide.

9. A foundry shape prepared in accordance with claim 8.

10. A process of casting a metal article comprising:

(a) fabricating an foundry shape in accordance with claim 8;

(b) pouring said metal while in the liquid state into said foundry shape;

(c) allowing said metal to cool and solidify; and (d) then separating the molded article.

* * * * *